US005590432A

United States Patent [19]

Taskey, Sr.

[11] Patent Number: 5,590,432

[45] Date of Patent: Jan. 7, 1997

[54] FASTENER DRIVING WIRE UNCOILING TOOL

[76] Inventor: Aaron R. Taskey, Sr., 5859 E. County Rd. 1100 North, Seymour, Ind. 47274

[21] Appl. No.: 415,243

[22] Filed: Apr. 3, 1995

[51] Int. Cl.[6] ..... B25B 25/00

[52] U.S. Cl. ..... 7/108; 140/124

[58] Field of Search ..... 7/107, 108, 165, 7/169; 81/436; 140/118, 124, 149

[56] References Cited

U.S. PATENT DOCUMENTS

| | | | |
|---|---|---|---|
| 758,829 | 5/1904 | Dodd | 140/124 |
| 2,870,809 | 1/1959 | Feldman et al. | 81/436 X |
| 3,343,577 | 9/1967 | Wagner | 81/436 X |
| 4,329,777 | 5/1982 | Murphy | 140/124 X |
| 4,480,512 | 11/1984 | Yaari | 81/436 |
| 4,680,996 | 7/1987 | Gold | 140/149 X |

*Primary Examiner*—James G. Smith

[57] ABSTRACT

A tool for driving a fastener and uncoiling a spool of wire. The inventive device includes a handle for being grasped and manipulated by an individual. A driving assembly extends from the handle for engaging a fastener to permit manual rotation of the fastener. A wire engaging assembly extends through the handle for engaging an end of a spool of wire, whereby the driving assembly can be engaged to a drill to permit powered rotation of the handle to effect uncoiling of the wire.

7 Claims, 5 Drawing Sheets

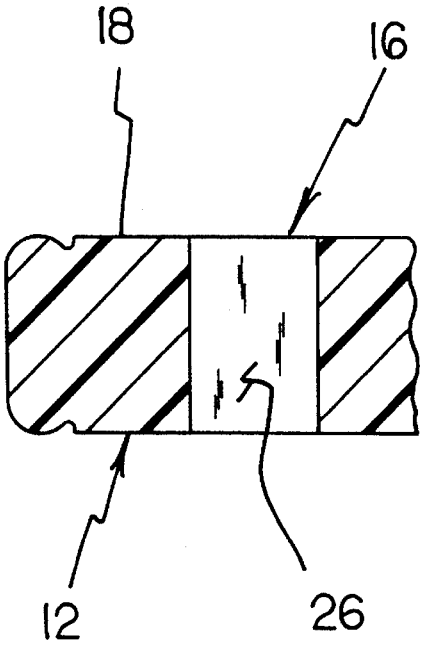
FIG. 3
FIG. 4
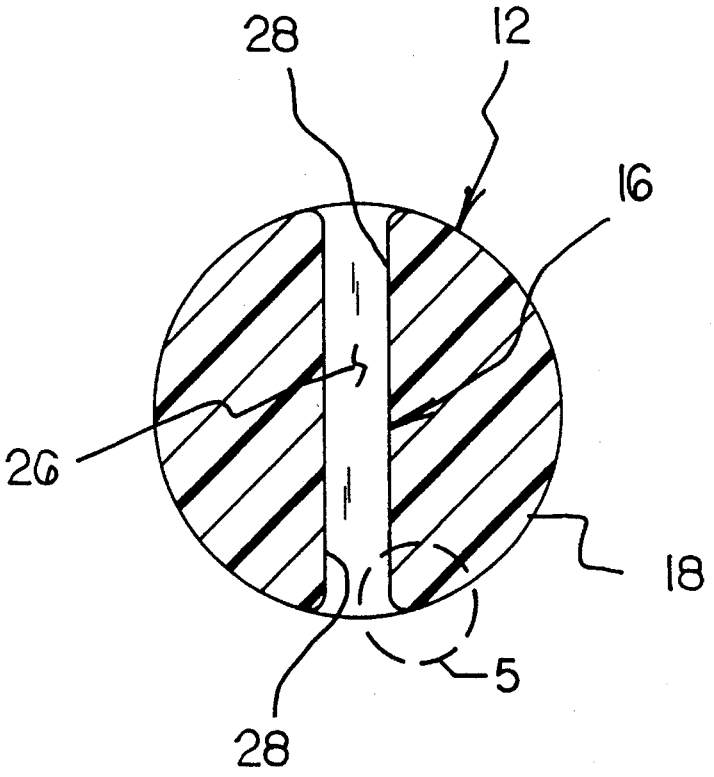

FASTENER DRIVING WIRE UNCOILING TOOL

BACKGROUND OF THE INVENTION

1. Field of the Invention

The present invention relates to tool structures and more particularly pertains to an fastener driving wire uncoiling tool driving a fastener and uncoiling a spool of wire.

2. Description of the Prior Art

The use of tool structures is known in the prior art. More specifically, tool structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool structures include U.S. Pat. No. 5,069,091; U.S. Pat. No. 4,951,533; U.S. Pat. No. 4,000,767; U.S. Pat. No. 3,797,546; and U.S. Pat. No. 3,656,523.

While these devices fulfill their respective, particular objectives and requirements, the aforementioned patents do not disclose a fastener driving wire uncoiling tool for driving a fastener and uncoiling a spool of wire which includes a handle for being grasped and manipulated by an individual, a driving assembly extending from the handle for engaging a fastener to permit manual rotation of the fastener, and a wire engaging assembly extending through the handle for engaging an end of a spool of wire, whereby the driving assembly can be engaged to a drill to permit powered rotation of the handle to effect uncoiling of the wire.

In these respects, the fastener driving wire uncoiling tool according to the present invention substantially departs from the conventional concepts and designs of the prior art, and in so doing provides an apparatus primarily developed for the purpose of driving a fastener and uncoiling a spool of wire.

SUMMARY OF THE INVENTION

In view of the foregoing disadvantages inherent in the known types of tool structures now present in the prior art, the present invention provides a new fastener driving wire uncoiling tool construction wherein the same can be utilized for driving a fastener and uncoiling a spool of wire. As such, the general purpose of the present invention, which will be described subsequently in greater detail, is to provide a new fastener driving wire uncoiling tool apparatus and method which has many of the advantages of the tool structures mentioned heretofore and many novel features that result in a fastener driving wire uncoiling tool which is not anticipated, rendered obvious, suggested, or even implied by any of the prior art tool structures, either alone or in any combination thereof.

To attain this, the present invention generally comprises tool for driving a fastener and uncoiling a spool of wire. The inventive device includes a handle for being grasped and manipulated by an individual. A driving assembly extends from the handle for engaging a fastener to permit manual rotation of the fastener. A wire engaging assembly extends through the handle for engaging an end of a spool of wire, whereby the driving assembly can be engaged to a drill to permit powered rotation of the handle to effect uncoiling of the wire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical intended to define the invention of the application, which is disclosure of the application. The abstract is neither measured by the claims, nor is it intended to be limiting as to the scope of the invention in any way.

It is therefore an object of the present invention to provide a new fastener driving wire uncoiling tool apparatus and method which has many of the advantages of the tool structures mentioned heretofore and many novel features that result in a fastener driving wire uncoiling tool which is not anticipated, rendered obvious, suggested, or even implied by any of the prior art tool structures, either alone or in any combination thereof.

It is another object of the present invention to provide a new fastener driving wire uncoiling tool which may be easily and efficiently manufactured and marketed.

It is a further object of the present invention to provide a new fastener driving wire uncoiling tool which is of a durable and reliable construction.

An even further object of the present invention is to provide a new fastener driving wire uncoiling tool which is susceptible of a low cost of manufacture with regard to both materials and labor, and which accordingly is then susceptible of low prices of sale to the consuming public, thereby making such fastener driving wire uncoiling tools economically available to the buying public.

Still yet another object of the present invention is to provide a new fastener driving wire uncoiling tool which provides in the apparatuses and methods of the prior art some of the advantages thereof, while simultaneously overcoming some of the disadvantages normally associated therewith.

Still another object of the present invention is to provide a new fastener driving wire uncoiling tool for driving a fastener and uncoiling a spool of wire.

Yet another object of the present invention is to provide a new fastener driving wire uncoiling tool which includes a handle for being grasped and manipulated by an individual, a driving assembly extending from the handle for engaging a fastener to permit manual rotation of the fastener, and a wire engaging assembly extending through the handle for engaging an end of a spool of wire, whereby the driving assembly can be engaged to a drill to permit powered rotation of the handle to effect uncoiling of the wire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a cross sectional view taken along line 4—4 of FIG. 1.

DESCRIPTION OF THE PREFERRED EMBODIMENT

Figure 1:
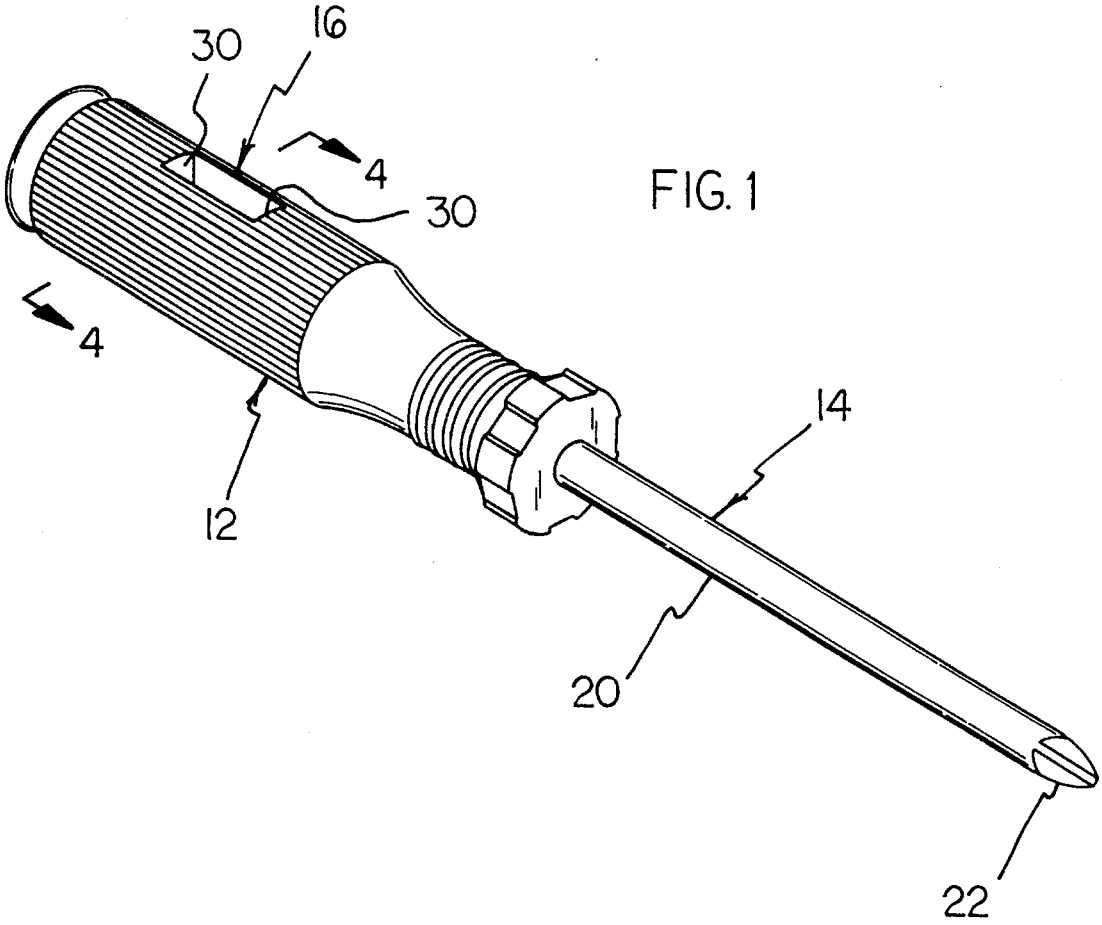
FIG. 1 is an isometric illustration of a fastener driving wire uncoiling tool according to the present invention.

With reference now to the drawings, and in particular to FIGS. 1–10 thereof, a new fastener driving wire uncoiling tool embodying the principles and concepts of the present invention and generally designated by the reference numeral 10 will be described.

More specifically, it will be noted that the fastener driving wire uncoiling tool 10 comprises a handle means 12 for being grasped and manipulated by an individual during use of the device 10. A driving means 14 projects from the handle means 12 for engaging an unillustrated fastener to effect manual rotation thereof by torque applied to the handle means 12 by an individual transferred through the driving means 14. A wire engaging means 16 is coupled to the handle means 12 for engaging an end of an unillustrated length of wire wound in a spiral fashion. By this structure, the driving means 14 can be engaged to a chuck of an unillustrated power drill, whereby rotation of the handle means 12 and the associated wire engaging means 16 can be accomplished to effect uncoiling of the wire from the spiral or spooled configuration.

Figure 2:
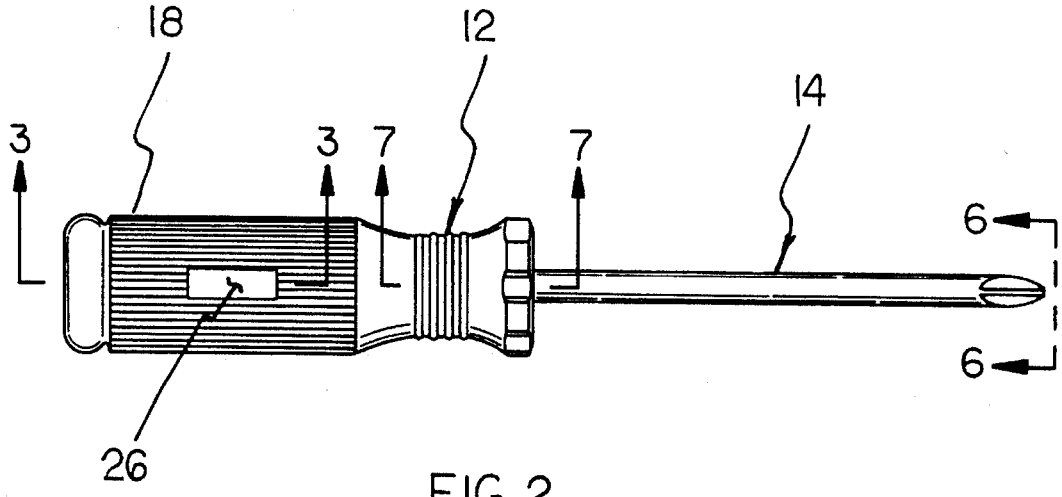
FIG. 2 is a top plane view thereof.

As best illustrated in FIG. 2, it can be shown that the handle means 12 according to the present invention 10 preferably comprises a solid handle member 18 sized for comfortable reception within a human hand. The solid handle member 18 is preferably symmetrically oriented about a longitudinal axis directed therethrough, whereby repeated application of the manual torque can be applied to the handle means 12 by an individual utilizing the device 10. By this structure, the handle means 12 can be manually rotated to effect subsequent rotation of the driving means 14 to facilitate driving or rotating of a screw or other similar fastener.

Figure 6:
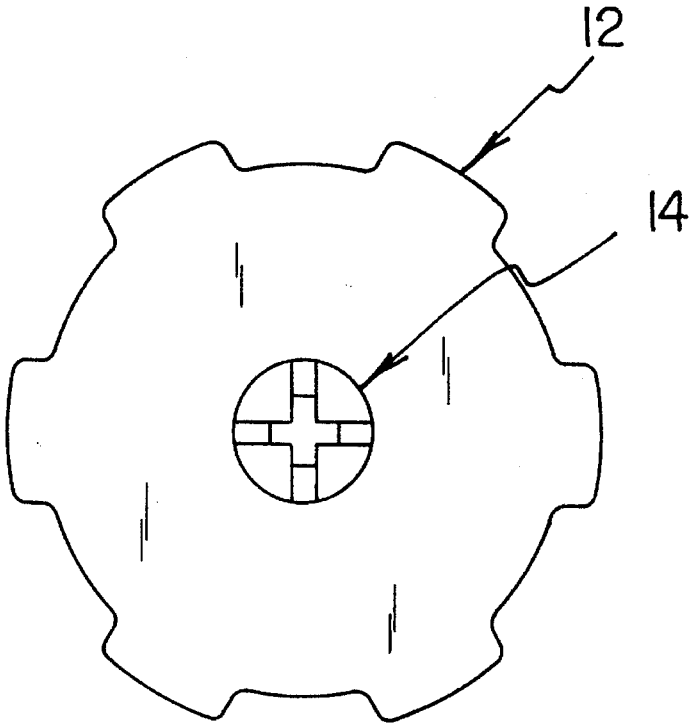
FIG. 6 is an end elevation view taken from line 6—6 of FIG. 2.
Figure 7:
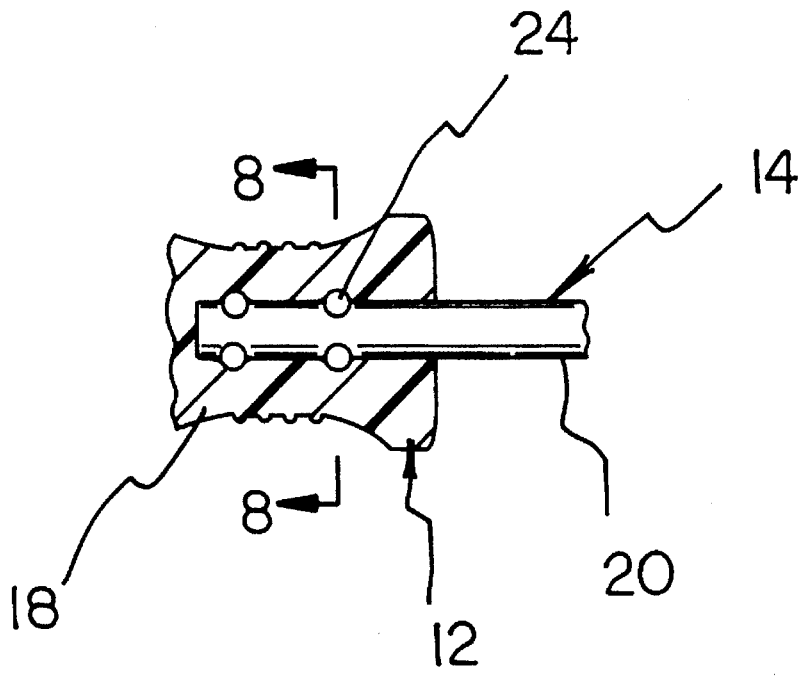
FIG. 7 is a cross sectional view taken along line 7—7 of FIG. 2.
Figure 8:
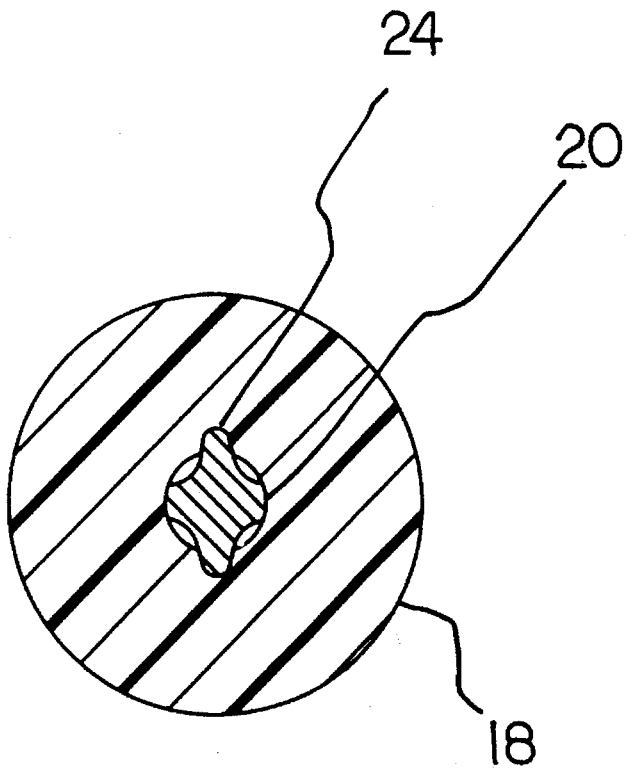
FIG. 8 is a cross sectional view taken along line 8—8 of FIG. 7.

Referring now to FIGS. 6 through 8 with concurrent reference to FIGS. 1 and 2, it can be shown that the driving means 14 according to the present invention 10 preferably comprises a tool shaft 20 of elongated configuration coupled to the solid handle member 18 and colinearly aligned with the longitudinal axis thereof. The tool shaft 20 terminates in an engaging tip 22 suitable for engaging an unillustrated fastener to facilitate manual application of torque to such fastener. As shown in FIG. 7 and 8, the tool shaft 20 is shaped so as to define a plurality of securing projections 24 within the solid handle member 18 which facilitates a transfer of rotation torque from the handle means 12 to the driving means 14. By this structure, the tool shaft 20 can be integrally molded into the solid handle member 18 by conventionally known molding techniques.

Figure 5:
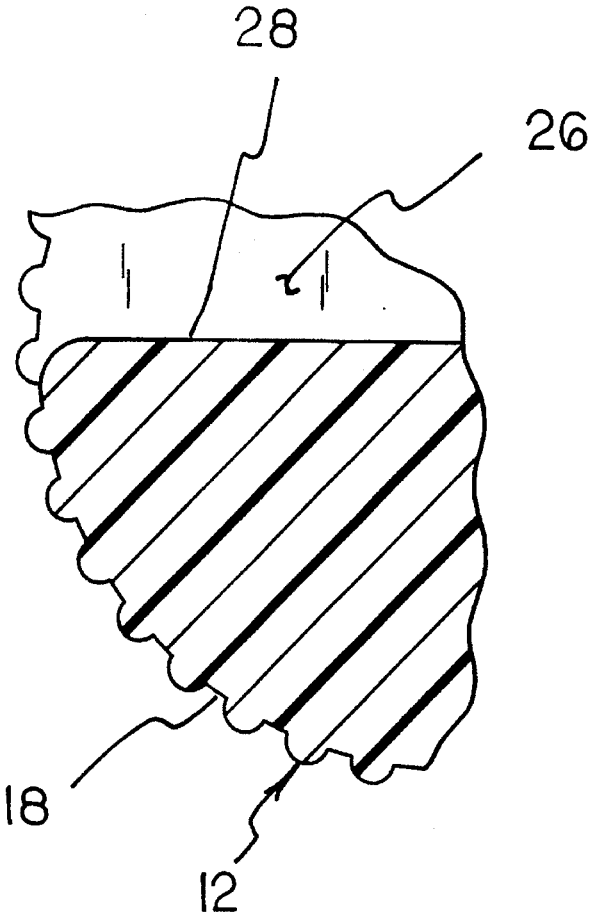
FIG. 5 is an enlarged cross sectional view of the area set forth in FIG. 4.

As best illustrated in the cross sectional views of FIGS. 3 through 5, it can be shown that the wire engaging means 16 according to the present invention 10 preferably comprises a rectangular aperture 26 directed through the solid handle member 18 of the handle means 12. The rectangular aperture 26 is defined by opposed facing major surfaces 28, as shown in FIG. 4, and opposed facing minor surfaces 30 which cooperate to define the substantially rectangular shape of the aperture 26. The aperture 26 is shaped so as to receive and frictionally engage an exterior casing of rectangular cross section and multi-stranded household wiring. By this structure, the tool shaft 20 of the driving means 14 can be secured to a chuck of an unillustrated power drill, with an end of a spool of wire being inserted through the rectangular aperture 26 of the wire engaging means 16, whereby an energization of the power drill will effect rotation of the end of the wire to uncoil such wire from a spiral or spooled configuration.

Figure 9:
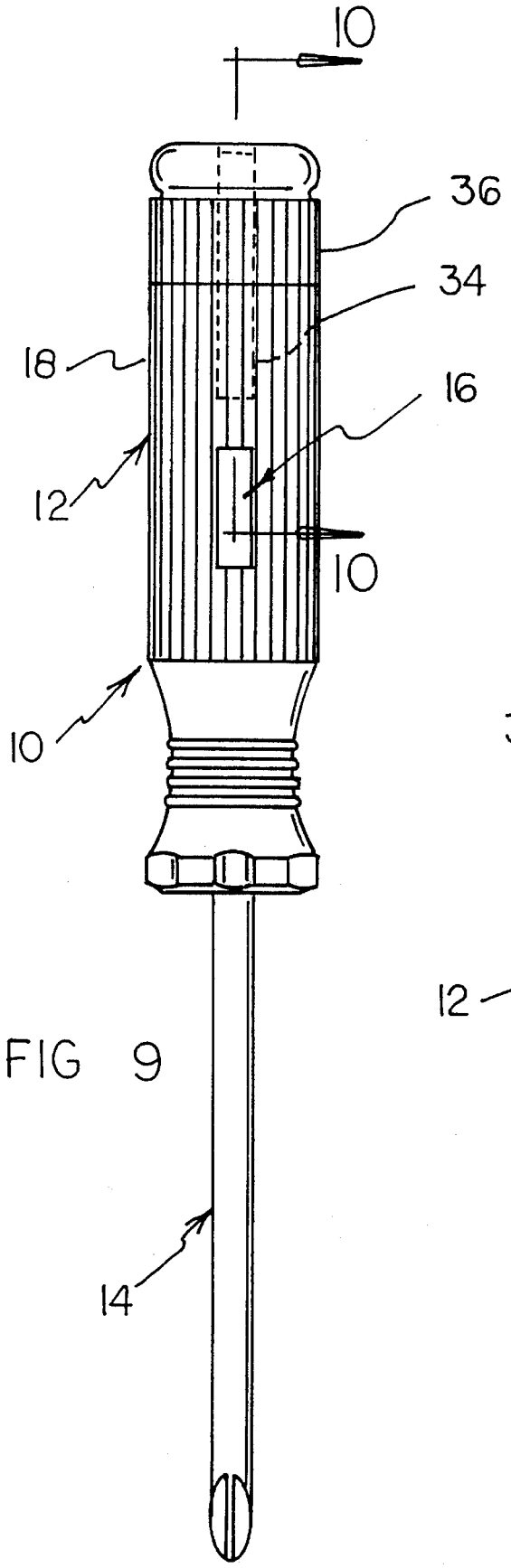
FIG. 9 is an elevational view of an alternative form of the invention including an auxiliary drive means.
Figure 10:
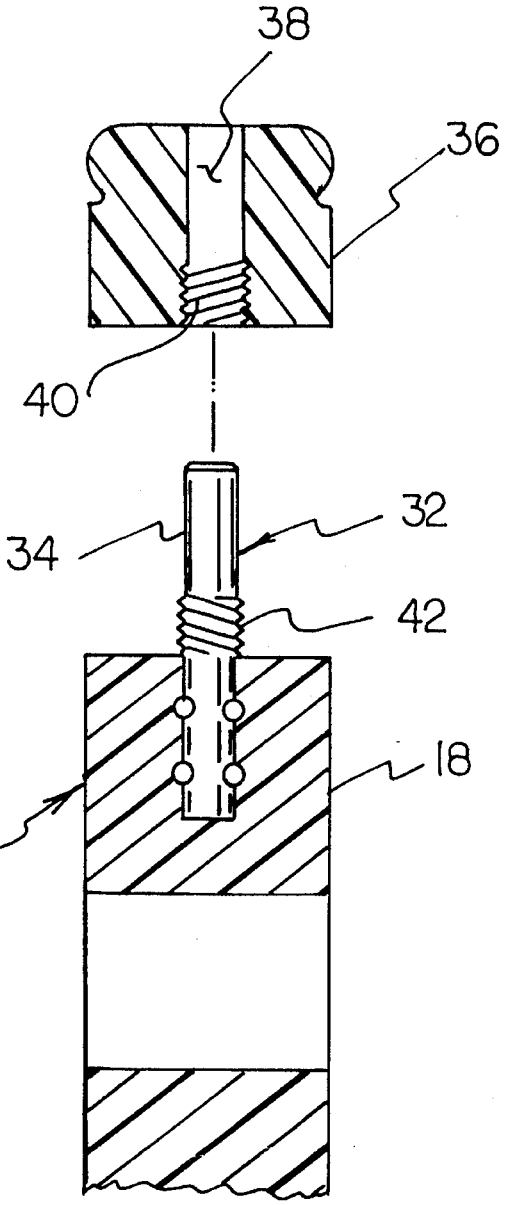
FIG. 10 is a cross sectional view taken along line 10—10 of FIG. 9.

As shown in FIGS. 9 and 10, the present invention may additionally comprise an auxiliary driving means 32 projecting from a second end of the solid handle member 18 of the handle means 12 for being engaged to a chuck of an unillustrated power drill, whereby rotation of the handle means 12 and the associated wire engaging means 16 can be accomplished to effect uncoiling of the wire from the spiral or spooled configuration, or alternatively, a fastener can be power driven by the driving means 14. The auxiliary driving means 32 thus preferably comprises an auxiliary driving shaft 34 fixedly secured to and projecting from a second end of the solid handle member. The auxiliary driving shaft 34 extends in a substantially colinear orientation relative to the driving means 14 to as to permit axial rotation of the driving means 14 about a longitudinal axis thereof when the auxiliary driving shaft is engaged to the chuck of a power drill. To effect concealment of the auxiliary driving shaft 34 during periods of non-use thereof and to provide an abutment surface against which a palm of a human hand can be engaged during manual use of the device 10, a removable cap 36 can be provided with the present invention 10. The cap 36 includes a central bore 38 directed at least partially thereinto and including interior threads 40 which are cooperatively engagable with exterior threads 42 formed along an exterior portion of the auxiliary driving shaft 34. By this structure, the cap 36 can be selectively removed from the device 10 to expose the auxiliary driving means 32, the auxiliary driving shaft 34 can then be coupled to the chuck of a power drill, whereby powered rotation of the driving means 14 about a longitudinal axis thereof can then be selectively accomplished.

In use, the fastener driving wire uncoiling tool can be easily utilized for driving a fastener and/or uncoiling a spool a wire. The device 10 permits a single tool to be utilized for a plurality of functions, thereby reducing storage and/or transportation space requirements of the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A fastener driving wire uncoiling tool comprising:

a handle means for being grasped and manipulated by an individual;

a driving means projecting from the handle means for engaging a fastener to effect manual rotation thereof and for coupling to a chuck of a drill;

a wire engaging means coupled to the handle means for engaging an end of a length of wire wound in a spiral configuration such that the driving means can be engaged to a chuck of a drill, whereby rotation of the handle means and the associated wire engaging means can be accomplished to effect uncoiling of the wire from the spiral configuration.

2. The fastener driving wire uncoiling tool of claim 1, wherein the handle means comprises a substantially solid handle member sized for comfortable reception within a human hand, the solid handle member being symmetrically oriented about a longitudinal axis directed therethrough.

3. The fastener driving wire uncoiling tool of claim 2, wherein the driving means comprises a tool shaft of elongated configuration coupled to the solid handle member and colinearly aligned with the longitudinal axis thereof, the tool shaft terminating in an engaging tip suitable for engaging a fastener to facilitate an application of torque to the fastener.

4. The fastener driving wire uncoiling tool of claim 3, wherein the wire engaging means comprises a rectangular aperture directed through the solid handle member of the handle means, the rectangular aperture being defined by opposed facing major surfaces, and opposed facing minor surfaces which cooperate to define a substantially rectangular shape of the aperture.

5. The fastener driving wire uncoiling tool of claim 4, and further comprising an auxiliary driving means projecting from the handle means for being engaged to a chuck of a power drill, whereby powered rotation of the handle means can be accomplished to effect rotation of the driving means about a longitudinal axis thereof.

6. The fastener driving wire uncoiling tool of claim 5, wherein the auxiliary driving means comprises an auxiliary driving shaft fixedly secured to and projecting from an end of the solid handle member, the auxiliary driving shaft extending in a substantially colinear orientation relative to the driving means to as to permit axial rotation of the driving means about a longitudinal axis thereof.

7. The fastener driving wire uncoiling tool of claim 6, wherein the auxiliary driving shaft includes exterior threads formed thereon, and further wherein the auxiliary driving means further comprises a removable cap removably mounted over the auxiliary driving shaft, the cap including a central bore directed at least partially thereinto and including interior threads which are cooperatively engaged with the exterior threads of the auxiliary driving shaft.

* * * * *